US008505582B2

(12) United States Patent
Gautier et al.

(10) Patent No.: US 8,505,582 B2
(45) Date of Patent: Aug. 13, 2013

(54) HYDRAULIC VALVE

(75) Inventors: Patrick Gautier, Stuttgart (DE); Marc Hohmann, Marktheidenfeld (DE); Wolf-Dietmar Schulze, Giessen (DE); Andre Selke, Naumburg (DE); Markus Todt, Neurtingen (DE)

(73) Assignee: Hilite Germany GmbH, Marktheidenfeld (DE)

( * ) Notice: Subject to any disclaimer, the term of this patent is extended or adjusted under 35 U.S.C. 154(b) by 210 days.

(21) Appl. No.: 13/066,990

(22) Filed: Apr. 28, 2011

(65) Prior Publication Data

US 2011/0266479 A1 Nov. 3, 2011

(30) Foreign Application Priority Data

May 3, 2010 (DE) ..... 10 2010 019 005

(51) Int. Cl.
*F16K 11/07* (2006.01)

(52) U.S. Cl.
USPC ..... 137/625.68; 123/90.17

(58) Field of Classification Search
USPC ..... 123/90.17; 137/625.25, 625.65, 137/625.67, 625.68
See application file for complete search history.

(56) References Cited

U.S. PATENT DOCUMENTS

| | | | |
|---|---|---|---|
| 699,273 | A | 5/1902 | Wolski |
| 894,286 | A | 7/1908 | Reineking |
| 1,746,855 | A | 2/1930 | French |
| 1,860,163 | A | 5/1932 | Wyzenbeek |
| 2,649,105 | A | 8/1953 | Stout et al. |
| 2,781,059 | A | 2/1957 | Frey |
| 2,918,941 | A | 12/1959 | Whiting |
| 3,779,669 | A | 12/1973 | Sommer |
| 3,783,590 | A | 1/1974 | Allen |
| 3,882,891 | A | 5/1975 | Viles et al. |
| 4,051,864 | A | 10/1977 | Iwatsuki |
| 4,241,758 | A | 12/1980 | Eiermann |
| 4,274,385 | A | 6/1981 | Yuzawa et al. |

(Continued)

FOREIGN PATENT DOCUMENTS

| | | |
|---|---|---|
| DE | 2 025 168 | 12/1971 |
| DE | 2 043 002 | 3/1972 |

(Continued)

OTHER PUBLICATIONS

Smith et al., "A Camshaft Torque-Actuated Vane-Style VCT Phaser", pp. 43-50 (SAE International, Jan. 2005).

(Continued)

*Primary Examiner* — John Rivell
*Assistant Examiner* — R. K. Arundale
(74) *Attorney, Agent, or Firm* — Lipsitz & McAllister, LLC

(57) ABSTRACT

A hydraulic valve for oscillating-motor camshaft adjuster is provided. The valve has a bush and a hollow piston with a piston bottom. The piston is axially movable within the bush by means of an actuator against the force of a screw-type pressure spring. The actuator is applied to the piston bottom. A sleeve secured in the bush is disposed inside the hollow piston and can be displaced relative to the piston. The wall of this sleeve has at least one through-opening, which leads to at least one opening of the hollow piston, which opening can guide a supply pressure (P) applied inside the sleeve alternatively to two sets of pressure chambers of the oscillating-motor camshaft adjuster. The sleeve has a sleeve bottom that seals off the inside space of hollow piston.

12 Claims, 5 Drawing Sheets

(56) References Cited

U.S. PATENT DOCUMENTS

| | | | | |
|---|---|---|---|---|
| 4,787,345 | A | 11/1988 | Thoma | |
| 4,854,649 | A | 8/1989 | Arikawa | |
| 5,138,985 | A | 8/1992 | Szodfridt et al. | |
| 5,323,806 | A | 6/1994 | Watari et al. | |
| 5,645,017 | A | 7/1997 | Melchior | |
| 5,657,725 | A * | 8/1997 | Butterfield et al. | 123/90.17 |
| 6,024,061 | A | 2/2000 | Adachi et al. | |
| 6,035,819 | A | 3/2000 | Nakayoshi et al. | |
| 6,053,139 | A | 4/2000 | Eguchi et al. | |
| 6,058,897 | A | 5/2000 | Nakayoshi | |
| 6,085,708 | A | 7/2000 | Trzmiel et al. | |
| 6,209,497 | B1 | 4/2001 | Niethammer et al. | |
| 6,234,125 | B1 | 5/2001 | Neubauer et al. | |
| 6,267,041 | B1 | 7/2001 | Skiba et al. | |
| 6,408,807 | B1 | 6/2002 | Komazawa et al. | |
| 6,453,859 | B1 | 9/2002 | Smith et al. | |
| 6,532,921 | B2 | 3/2003 | Sato et al. | |
| 6,739,297 | B2 | 5/2004 | Palesch et al. | |
| 6,763,791 | B2 | 7/2004 | Gardner et al. | |
| 6,782,856 | B2 | 8/2004 | Aimone | |
| 6,814,036 | B2 | 11/2004 | Palesch et al. | |
| 6,820,578 | B2 | 11/2004 | Kanada et al. | |
| 6,845,740 | B2 | 1/2005 | Kohrs | |
| 6,871,621 | B2 | 3/2005 | Palesch et al. | |
| 6,883,481 | B2 | 4/2005 | Gardner et al. | |
| 6,899,126 | B2 | 5/2005 | Weigand et al. | |
| 6,941,912 | B2 | 9/2005 | Palesch et al. | |
| 6,968,815 | B2 | 11/2005 | Palesch et al. | |
| 7,011,059 | B2 | 3/2006 | Plank et al. | |
| 7,025,023 | B2 | 4/2006 | Lehmann et al. | |
| 7,121,553 | B2 | 10/2006 | Cornea et al. | |
| 7,124,722 | B2 | 10/2006 | Smith | |
| 7,198,013 | B2 | 4/2007 | Palesch et al. | |
| 7,219,636 | B2 | 5/2007 | Sawada | |
| 7,240,768 | B2 | 7/2007 | Sageman | |
| 7,314,031 | B2 | 1/2008 | Le Troadec et al. | |
| 7,331,318 | B2 | 2/2008 | Schweizer | |
| 7,387,097 | B2 | 6/2008 | Schmitt et al. | |
| 7,444,971 | B2 | 11/2008 | Suga et al. | |
| 7,513,230 | B2 | 4/2009 | Knecht et al. | |
| 7,533,695 | B2 | 5/2009 | Strauss et al. | |
| 7,584,728 | B2 | 9/2009 | Berndorfer | |
| 7,600,531 | B2 | 10/2009 | Patze et al. | |
| 7,681,542 | B2 | 3/2010 | Paul et al. | |
| 7,836,857 | B2 | 11/2010 | Knecht et al. | |
| 7,866,289 | B2 | 1/2011 | Grunow et al. | |
| 7,946,266 | B2 | 5/2011 | Knecht et al. | |
| 7,987,827 | B2 | 8/2011 | Fujiyoshi et al. | |
| 8,225,818 | B1 * | 7/2012 | Stephens et al. | 137/625.68 |
| 2002/0062803 | A1 | 5/2002 | Sato et al. | |
| 2002/0088413 | A1 | 7/2002 | Smith et al. | |
| 2002/0088417 | A1 | 7/2002 | Palesch et al. | |
| 2003/0033999 | A1 | 2/2003 | Gardner et al. | |
| 2003/0070713 | A1 * | 4/2003 | Cornea et al. | 137/512.15 |
| 2003/0116110 | A1 | 6/2003 | Kohrs | |
| 2003/0177991 | A1 | 9/2003 | Palesch et al. | |
| 2003/0188705 | A1 | 10/2003 | Aimone | |
| 2004/0112314 | A1 | 6/2004 | Kanada et al. | |
| 2004/0211379 | A1 | 10/2004 | Palesch et al. | |
| 2004/0226526 | A1 | 11/2004 | Palesch et al. | |
| 2004/0244852 | A1 | 12/2004 | Cornea et al. | |
| 2005/0022760 | A1 | 2/2005 | Panciroli | |
| 2005/0051123 | A1 | 3/2005 | Haser et al. | |
| 2005/0056245 | A1 | 3/2005 | Plank et al. | |
| 2005/0072397 | A1 | 4/2005 | Sluka et al. | |
| 2005/0241603 | A1 | 11/2005 | Palesch et al. | |
| 2005/0252561 | A1 | 11/2005 | Strauss et al. | |
| 2005/0257762 | A1 | 11/2005 | Sawada | |
| 2006/0201463 | A1 | 9/2006 | Schweizer | |
| 2006/0225791 | A1 | 10/2006 | Patze et al. | |
| 2007/0074687 | A1 | 4/2007 | Bosl-Flierl et al. | |
| 2007/0074692 | A1 | 4/2007 | Schafer et al. | |
| 2007/0266971 | A1 | 11/2007 | Bosl-Flierl et al. | |
| 2008/0115751 | A1 | 5/2008 | Knecht et al. | |
| 2008/0149056 | A1 | 6/2008 | Grunow | |
| 2008/0149057 | A1 | 6/2008 | Grunow et al. | |
| 2008/0184950 | A1 | 8/2008 | Lawrence et al. | |
| 2008/0264200 | A1 | 10/2008 | Hoppe et al. | |
| 2008/0301938 | A1 | 12/2008 | Bonse et al. | |
| 2009/0020178 | A1 | 1/2009 | Stallmann | |
| 2009/0056656 | A1 | 3/2009 | Strauss | |
| 2009/0057588 | A1 * | 3/2009 | Reilly | 251/129.15 |
| 2009/0071426 | A1 | 3/2009 | Knecht et al. | |
| 2009/0133652 | A1 | 5/2009 | Fujyoshi et al. | |
| 2009/0159024 | A1 * | 6/2009 | Paul et al. | 123/90.15 |
| 2009/0159829 | A1 | 6/2009 | Hoppe et al. | |
| 2009/0223049 | A1 | 9/2009 | Binder et al. | |
| 2009/0241878 | A1 | 10/2009 | Yamaguchi | |
| 2009/0272349 | A1 | 11/2009 | Methley et al. | |
| 2009/0293826 | A1 | 12/2009 | Lancefield et al. | |
| 2010/0199936 | A1 | 8/2010 | Weiss et al. | |
| 2010/0269772 | A1 | 10/2010 | Takemura et al. | |
| 2010/0288215 | A1 | 11/2010 | Takemura et al. | |
| 2010/0300388 | A1 | 12/2010 | Lang et al. | |
| 2011/0094464 | A1 | 4/2011 | Eimert | |
| 2011/0162603 | A1 | 7/2011 | Busse | |
| 2011/0174253 | A1 | 7/2011 | Hoppe et al. | |
| 2011/0197835 | A1 | 8/2011 | Boegershausen | |
| 2011/0239966 | A1 | 10/2011 | Strauss | |
| 2012/0145100 | A1 | 6/2012 | Meinig et al. | |

FOREIGN PATENT DOCUMENTS

| | | |
|---|---|---|
| DE | 36 01 643 | 7/1987 |
| DE | 38 29 698 | 3/1989 |
| DE | 42 10 580 | 10/1993 |
| DE | 42 35 929 | 4/1994 |
| DE | 44 22 742 | 1/1996 |
| DE | 195 25 837 | 1/1997 |
| DE | 199 14 156 | 10/1999 |
| DE | 199 18 910 | 11/1999 |
| DE | 198 23 619 | 12/1999 |
| DE | 198 44 669 | 3/2000 |
| DE | 198 47 705 | 4/2000 |
| DE | 198 53 670 | 5/2000 |
| DE | 199 52 275 | 5/2000 |
| DE | 100 50 225 | 4/2002 |
| DE | 101 58 530 | 8/2002 |
| DE | 101 61 698 | 6/2003 |
| DE | 101 61 701 | 6/2003 |
| DE | 102 05 415 | 8/2003 |
| DE | 102 11 467 | 9/2003 |
| DE | 102 28 354 | 1/2004 |
| DE | 103 44 816 | 5/2004 |
| DE | 103 30 449 | 2/2005 |
| DE | 103 34 690 | 3/2005 |
| DE | 103 44 916 | 4/2005 |
| DE | 60201949 | 4/2005 |
| DE | 103 46 448 | 6/2005 |
| DE | 10 2004 038 252 | 12/2005 |
| DE | 10 2005 023 056 | 12/2005 |
| DE | 10 2005 004 281 | 1/2006 |
| DE | 10 2004 035 077 | 2/2006 |
| DE | 602 07 308 | 3/2006 |
| DE | 10 2004 039 800 | 5/2006 |
| DE | 10 2005 013 085 | 6/2006 |
| DE | 10 2005 034 275 | 1/2007 |
| DE | 10 2005 034 276 | 1/2007 |
| DE | 10 2006 012 733 | 9/2007 |
| DE | 10 2006 012 775 | 9/2007 |
| DE | 10 2006 036 052 | 2/2008 |
| DE | 10 2007 012 967 | 8/2008 |
| DE | 10 2007 040 017 | 2/2009 |
| DE | 10 2007 041 552 | 3/2009 |
| DE | 10 2007 053 688 | 5/2009 |
| DE | 10 2008 005 277 | 7/2009 |
| DE | 10 2009 022 869 | 12/2010 |
| DE | 10 2009 035 233 | 3/2011 |
| DE | 10 2009 050 779 | 4/2011 |
| EP | 0 069 531 | 1/1983 |
| EP | 0 245 791 | 11/1987 |
| EP | 0 388 244 | 9/1990 |
| EP | 0 799 976 | 10/1997 |
| EP | 0 799 977 | 10/1997 |
| EP | 0 821 138 | 1/1998 |

| | | |
|---|---|---|
| EP | 0 834 655 | 4/1998 |
| EP | 0 859 130 | 8/1998 |
| EP | 0 896 129 | 2/1999 |
| EP | 0 924 393 | 6/1999 |
| EP | 1 008 729 | 6/2000 |
| EP | 1 197 641 | 4/2002 |
| EP | 1 291 563 | 3/2003 |
| EP | 1 347 154 | 9/2003 |
| EP | 1 447 602 | 8/2004 |
| EP | 1 475 518 | 11/2004 |
| EP | 1 477 636 | 11/2004 |
| EP | 1 703 184 | 9/2006 |
| EP | 1 476 642 | 1/2008 |
| EP | 2 093 388 | 8/2009 |
| FR | 525 481 | 12/1921 |
| FR | 966 121 | 12/1951 |
| FR | 996 121 | 12/1951 |
| GB | 1 212 327 | 11/1970 |
| GB | 2 161 583 | 1/1986 |
| JP | 57-13094 | 1/1957 |
| JP | 55-72965 | 6/1980 |
| JP | 57-13094 | 1/1982 |
| WO | 99/67537 | 12/1999 |
| WO | 03/078804 | 9/2003 |
| WO | 2004/088094 | 10/2004 |
| WO | 2004/088099 | 10/2004 |
| WO | 2007068586 | 6/2007 |
| WO | 2008009983 | 1/2008 |
| WO | 2008/140897 | 11/2008 |
| WO | 2009071457 | 6/2009 |
| WO | 2010/040617 | 4/2010 |

OTHER PUBLICATIONS

Pohl, Dirk, et al., "Vanecam® FastPhaser—Camphasing System for Improvement of Phasing Rate and Reduction of Oil Consumption", Konfernz Haus der Technik Variable Ventilsteuerung, 17 pages, Feb. 2007.

* cited by examiner

HYDRAULIC VALVE

This application claims the benefit of German patent application number DE 10 2010 019 005.5 filed on May 3, 2010, which is incorporated herein by reference in its entirety and for all purposes.

BACKGROUND OF THE INVENTION

The invention relates to a hydraulic valve and its use for an oscillating-motor camshaft adjuster.

A hydraulic valve for an oscillating-motor camshaft adjuster is already known from DE 10 2004 038 252 A1. The hydraulic valve has a bush and a hollow piston that can be shifted axially inside this bush against the force of a screw-type pressure spring by means of an actuator. A sleeve is provided inside the hollow piston. A supply pressure P can be guided alternatively to two working ports A, B or two pressure chambers of the oscillating-motor camshaft adjuster by means of the hydraulic valve. Two tank ports T1, T2 are provided. The sequence of the radial ports is P-T1-B-A. The second tank port T2 then follows as an axial port on the front side.

A hydraulic valve designed as a cartridge valve is already known from DE 10 2005 013 085 B3. This hydraulic valve has three ports B, P, A, which are axially displaced relative to one another and which are present as openings in a bush of the hydraulic valve. A band-shaped non-return valve is inserted inside this bush.

SUMMARY OF THE INVENTION

The object of the invention is to create a cost-effective and small oscillating-motor camshaft adjuster having a high control performance.

This problem is solved according to the embodiments of the invention set forth herein.

According to one example embodiment of the invention, a hydraulic valve for an oscillating-motor camshaft adjuster is provided. A sleeve is disposed in a relatively moveable manner inside the hollow piston of the hydraulic valve. This sleeve, however, can maintain its position relative to a bush within which the hollow piston can be moved. In this way, a limited axial play and a limited radial play can be provided, which prevents a jamming of the parts moving against each other or equilibrates tolerances. The sleeve has a sleeve bottom that seals off the inside space of the hollow piston. This sleeve bottom is solidly supported relative to the bush, so that the forces arising from the pressure from a supply port P are supported at the bush via the sleeve bottom and the sleeve. Because of this, these forces do not act on the piston bottom of the hollow piston, which serves for support for an actuator. Thus, since the hollow piston is free of axial forces from the supply pressure, the axial position of the hollow piston can be controlled by the actuator, without needing to consider the supply pressure. This is of particular advantage, since the supply pressure can fluctuate depending on how it is provided. Usually, since an oil pump which is driven mechanically by the internal combustion engine is used, the supply pressure fluctuates depending on the engine speed and temperature or viscosity of the oil. In addition, other factors may play a role.

The particularly high control performance that can be achieved according to the invention offers a particular advantage, if it is combined with a hydraulic construction that utilizes the camshaft alternating torques for supporting the angle adjustment by means of the oscillating-motor camshaft adjuster. That is, this utilization establishes higher requirements for control of the hydraulic valve, since these camshaft alternating torques operate in a non-uniform and rapidly fluctuating manner. Such a function for utilizing camshaft alternating torques is already known from DE 10 2006 012 733 B4 and DE 10 2006 012 775 B4. The hydraulic valve according to the invention can consequently be configured in such a way that it makes possible, in a particularly advantageous way, the utilization of pressure fluctuations in the pressure chambers of the oscillating-motor camshaft adjuster that are assigned to the first working port B, in order to supply the pressure chambers assigned to the opposite direction of rotation with sufficiently fluid flow volume. These pressure fluctuations result from the camshaft alternating torques that are established on the camshaft in reaction to the forces of the gas exchange valves. In each case, the fewer the number of combustion chambers there is per camshaft, the larger will be the camshaft alternating torques, so that the advantages of utilizing camshaft alternating torques are particularly effective in the case of internal combustion engines with few, for example, three, cylinders. Further, the influence parameters are still the strength of the springs of the gas exchange valves and the camshaft rpm.

The phase adjustment of the camshaft can thus be produced rapidly. In addition, as a consequence of utilizing camshaft alternating torques in an advantageous manner, it is possible to make an adjustment with a relatively low oil pressure. A small dimensioning of the oil pump made possible in this way improves the efficiency of the internal combustion engine. The flow volumes of hydraulic fluid that are saved are available for other uses, such as, for example, adjusting the hydraulic valve stroke.

The camshaft alternating torques can be utilized for both directions of rotation, but they can also be utilized for only one direction of rotation. In the case of utilizing the camshaft alternating torques only in one direction of rotation, a flat spiral spring according to DE 10 2006 036 052 A1 can be used, which then compensates for the additional adjusting forces in one direction of rotation.

The camshaft alternating torques are utilized in this case by means of a non-return valve that can be designed particularly in a band shape.

The hydraulic valve in this case can be designed as a central valve in a particularly preferred embodiment, whereby the supply pressure is introduced via the camshaft. Such a central valve has advantages relative to structural space. External hydraulic valves for actuating the oscillating-motor camshaft adjuster represent the counterpart of a central valve. In the case of an external hydraulic valve, the hydraulic channels for the camshaft adjustment run from the oscillating-motor camshaft adjuster to a separate control drive cover having the hydraulic valve screwed thereon or, to the cylinder head having the hydraulic valve screwed therein. In contrast, the central valve, which is also hydraulic, is disposed radially inside the rotor hub of the oscillating-motor camshaft adjuster. In the case of the central valve, the method employed for the more rapid adjustment of the oscillating-motor camshaft adjuster, which is described in DE 10 2006 012 733 B4 and DE 10 2006 012 775 B4 named above, is particularly effective, since the hydraulic fluid from the chambers assigned to one direction of rotation has a short path into the chambers assigned to the other direction of rotation. If, in contrast, the hydraulic fluid were to have a long path from the rotor hub to an external hydraulic valve, then with increasing line length, the line losses would obliterate the advantage. Of course, challenges with respect to the control technology that create a special advantage for the pressure-equilibrated hollow piston according to the invention go hand in hand with the direct action of the camshaft alternating torques via a central valve instead of via a damping path.

The bush of a central valve can be designed in a particularly advantageous way with a thread for screwing the rotor to the camshaft, so that a so-called central screw is formed.

The supply pressure, however, need not be introduced into the bush axially on the front side. It is also possible to provide the supply port radially, so that the supply pressure is also radially introduced into the hydraulic valve. The supply pressure, however, need not be introduced into the sleeve on the front side. It is also possible to introduce the pressure into the bush via a cross bore, which then leads into the inside space of the sleeve. In this way, the introduction can be made into the sleeve in its front-side opening or, however, in an opening in said wall of the sleeve.

According to the invention, the sleeve must be fixed relative to the bush. This means that the sleeve is solidly supported relative to the bush. In this case, the support of the pressure-relieving sleeve is preferably provided only in the axial direction. In contrast, the sleeve has a radial play in an advantageous configuration, for which reason the good functioning of the hydraulic piston is assured. In order to assure a tight sealing between the bush and the sleeve despite a large radial play, hydraulic fluid from the supply port is prevented from getting outside past the bush, in a particularly advantageous manner, by providing a sealing ring, which compensates for the radial play, in the region of this radial play.

If, in the normal operation of the hydraulic valve, the supply pressure is applied continually at the bottom of the sleeve, then a support exclusively in this direction may also be sufficient, since a displacement of the sleeve in the direction pointing out from the actuator is then prevented by the supply pressure. This applies even more so, if the sleeve is fitted in the bush so that friction forces also act between the sleeve and the bush. These friction forces are consequently to be kept small by means of appropriate material pairings, tolerances, component surfaces and structural measures.

The hollow piston is completely pressure-equilibrated in a particularly advantageous manner. It is also possible, however, to design the hollow piston with slightly varying outer diameter. In this case, unfortunately, there is little controllability. In return, however, assembly is simplified, since the hollow piston is preferably configured in such a way that its region that is to be introduced first has a smaller diameter than its region that is subsequently to be introduced. The probability of damage to the working surfaces/sealing surfaces during assembly is reduced, particularly in the case of manual assembly.

Other example embodiments of the present invention discussed below have particularly advantageous configurations, which equilibrate tolerances caused in the manufacture via a radial or an axial play, so that jamming of the hollow piston cannot occur.

Additional advantages of the invention are derived from the description and the drawing.

BRIEF DESCRIPTION OF THE DRAWINGS

The present invention will hereinafter be described in conjunction with the appended drawing figures, wherein like reference numerals denote like elements.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims. The angular position at the camshaft is changed with an oscillating-motor camshaft adjuster 14 according to FIG. 1 during the operation of an internal combustion engine. By rotating the camshaft, the opening and closing time points of the gas exchange valves are shifted so that the internal combustion engine offers its optimal performance at the particular speed involved. The oscillating-motor camshaft adjuster 14 thus makes possible a continual adjustment of the camshaft relative to the crankshaft. Oscillating-motor camshaft adjuster 14 has a cylindrical stator 1, which is connected to a drive wheel 2 in a way that is torsionally rigid. In the example embodiment shown in FIG. 1, drive wheel 2 is a chain wheel, by means of which a chain, which is not shown in more detail, is guided. Drive wheel 2, however, may also be a toothed belt gear, by means of which a drive belt is guided as a drive element. Stator 1 is drive-connected to the crankshaft by means of this drive element and drive wheel 2.

Figure 2:
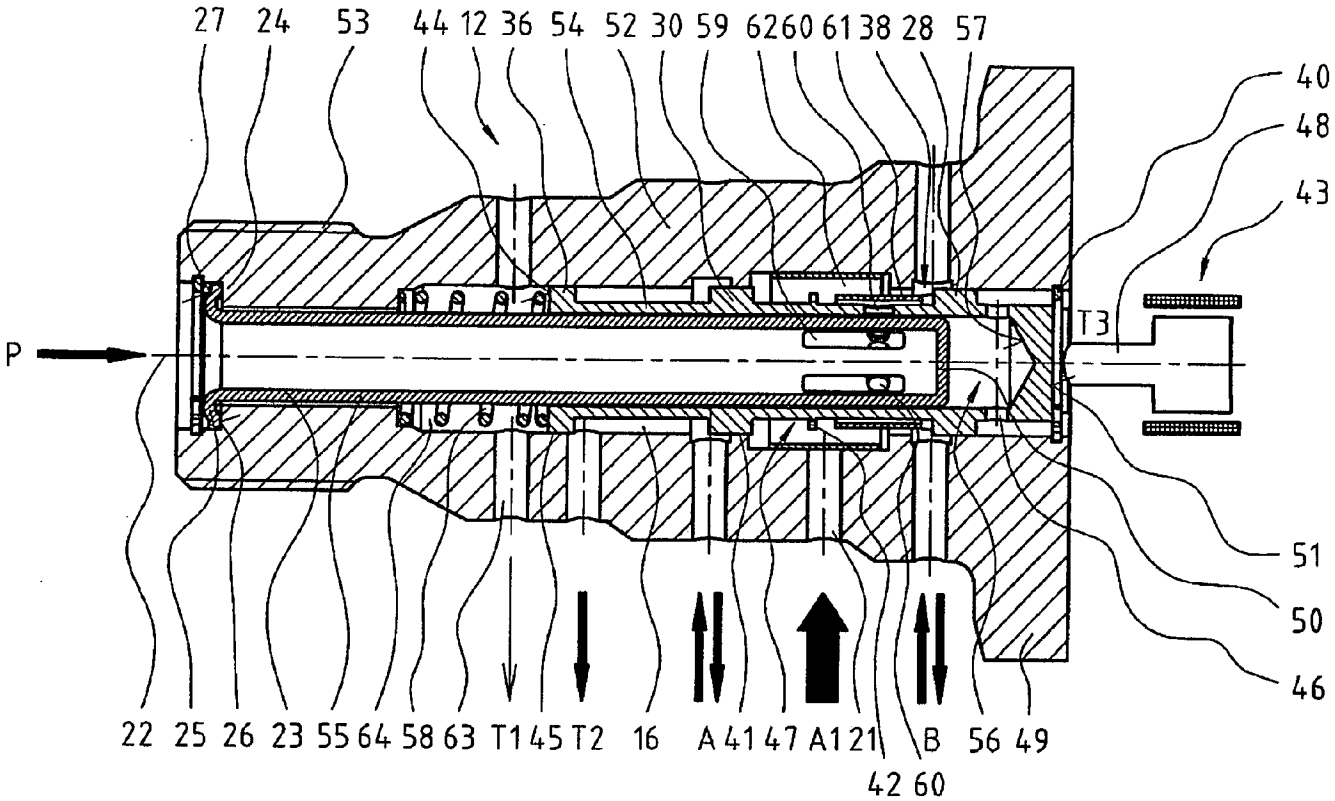
FIG. 2 shows an example embodiment of a hydraulic valve for adjusting an oscillating-motor camshaft adjuster according to FIG. 1 in a first valve position in a half-section.

Stator 1 comprises a cylindrical stator base 3, on the inner side of which webs 4 protrude radially toward the inside at equal distances. Intermediate spaces 5 into which pressure medium is introduced via a hydraulic valve 12, which is shown in further detail in FIG. 2, are formed between adjacent webs 4. Vanes 6, which protrude radially toward the outside from a cylindrical rotor hub 7 of a rotor 8, project between adjacent webs 4. These vanes 6 subdivide the intermediate spaces 5 between webs 4 into two sets of pressure chambers 9 and 10.

Webs 4 are applied tightly by their front sides to the outer jacket surface of rotor hub 7. Vanes 6 in turn are applied tightly by their front sides to the cylindrical inner wall of stator base 3.

Rotor 8 is connected in a way that is torsionally rigid relative to the camshaft, which is not shown in further detail. In order to change the angular position between the camshaft and the crankshaft, rotor 8 is rotated relative to stator 1. For this purpose, depending on the desired direction of rotation each time, the pressure medium in either pressure chambers 9 or pressure chambers 10 is pressurized, while the other pressure chambers 10 or 9 are relieved of pressure to the tank. In order to pivot rotor 8 relative to stator 1 in a counterclockwise direction in the position shown, radial hub bores 11 in rotor hub 7 are pressurized by hydraulic valve 12. In order to pivot rotor 8, in contrast, in the clockwise direction, additional radial hub bores 13 in rotor hub 7 are pressurized by hydraulic valve 12. These additional radial hub bores 13 are arranged offset axially and circumferentially to the first-named radial hub bores 11. Hydraulic valve 12 is inserted as a so-called central valve into rotor hub 7 and screwed with the camshaft lying behind it.

Rotor 8 is pre-stressed against stator 1 in a torsionally elastic manner by means of a flat spiral spring acting as a compensation spring in a way that is not shown in the drawing.

FIG. 2 shows hydraulic valve 12. This valve has a screw-shaped bush 52 with an axial supply port P, from which hydraulic pressure coming from an oil pump, which is not shown in more detail, can be guided, as desired, to a first working port A or a second working port B. These two working ports A, B in this case lead into annular grooves 31, 32 in rotor hub 7. The first working port A in this case leads into said radial hub bores 11 via first annular groove 31 assigned to this working port A. In contrast, the second working port B leads into the other radial hub bores 13 via annular groove 32 assigned to this working port B.

Another port A1, which is formed by a cross bore 21 in bush 52 and which is assigned for the utilization of camshaft alternating torques, leads into the first annular groove assigned to the first working port A.

In addition, bush 52 has another two radial tank ports T1, T2 and an axial tank port T3. The first two radial tank ports T1, T2 are disposed axially adjacent to one another next to the two working ports A, B. In this case, the sequence of radial ports from the internal combustion engine to an actuator 43 is T1-T2-A-A1-B, successively. The axial or third tank port T3, in contrast, leads out from hydraulic valve 12 at a screw head 49 of bush 52, which is designed in screw shape.

The first radial tank port T1 in this case does not serve for the discharge of oil from the respective pressure chambers 9 or 10 to be relieved of pressure. Instead, this first tank port T1 serves for volume equilibration or for venting.

Bush 52 terminates on the engine side with an outer thread 53, which is screwed into an inner thread of the camshaft, which is not shown in further detail, and clamps rotor 8 against the camshaft in a frictionally engaged, torsionally rigid manner. For this purpose, rotor hub 7, on the one hand, is applied to the front-side end of the camshaft via a thin friction disk, and, on the other hand, to screw head 49 of bush 52. Such a friction disk, but with oil guides, is, for example, the subject of DE 10 2009 050 779.5.

Figure 1:
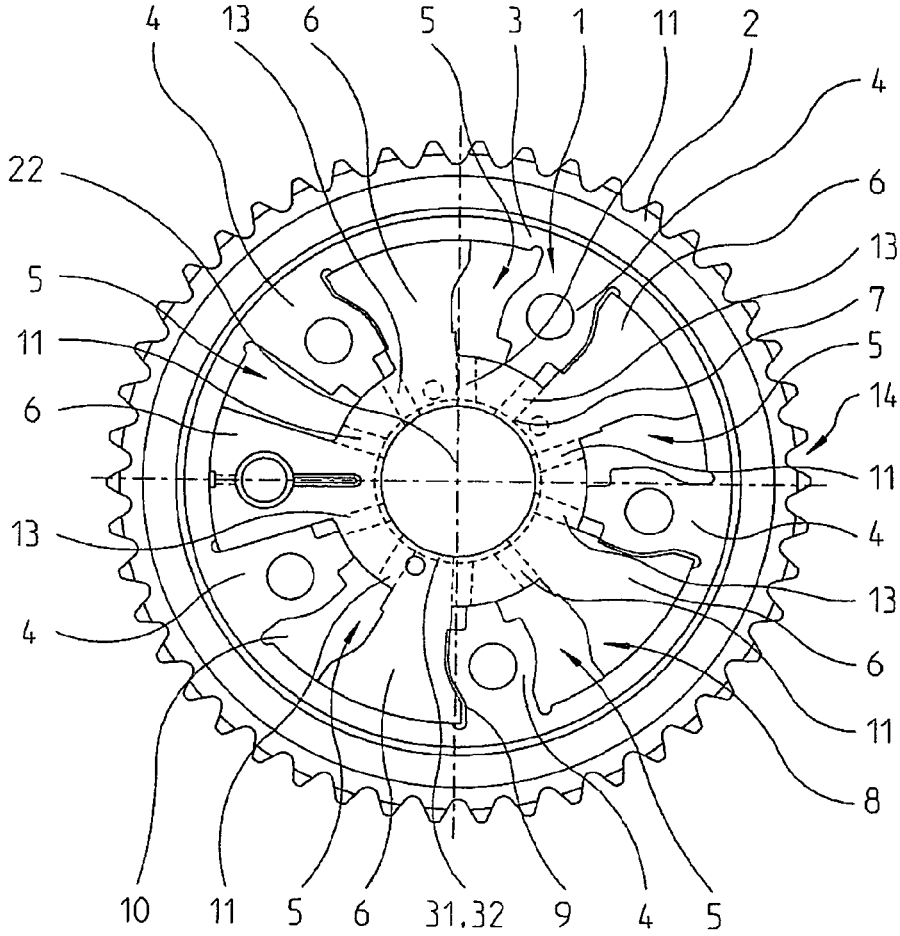
FIG. 1 shows an example embodiment of an oscillating-motor camshaft adjuster in accordance with the present invention in a sectional view.

A hollow piston 54 can be displaced inside bush 52. For this purpose, a tappet 48 of an electromagnetic linear actuator 43, which is shown only in a rudimentary manner in FIG. 2, is applied at a piston bottom 51 of hollow piston 54. In the non-energized state of the actuator, which is shown, the hydraulic pressure coming from an axial supply port P is guided to a second working port B. The pressure chambers 9, which are shown in FIG. 1, are loaded with hydraulic pressure via hub bores 13 from this second working port B. The hydraulic fluid that is unavoidably guided from the oppositely aligned pressure chambers 10 via hub bores 11 to the first working port A can be drawn from hydraulic valve 12 to the second tank port T2.

The supply port P coming from an oil pump of the internal combustion engine, for example, via the camshaft, is axial. A cup-shaped, closed sleeve 55 is inserted into the hollow piston 54 which is hollowed out in the form of a blind hole 56. Its sleeve bottom 50 prevents the pressure of supply port P from acting on blind hole base 57 and thus force-loading hollow piston 54 in addition to a screw-type pressure spring 58. Because of this, electromagnetic linear-acting actuator 43 disengaging tappet 48 does not introduce a force against the varying pressure of supply port P. The control or regulating performance of the central valve is thus very good. Sleeve bottom 50 is supported for this purpose at bush 52 via a wall 23 of sleeve 55. Consequently, the entire sleeve 55 is secured in the bush. Sleeve 55 has a radially outwardly projecting collar 25 on its side facing away from tappet 48, and this collar is applied to a shoulder 24 of bush 52 on its side 26 facing tappet 48. An axial locking ring 29, which is inserted in an inner annular groove of bush 52, is applied onto the other side 27 of bush 52. In this way, sleeve 55 is secured in both directions against an axial displacement along a central axis 22.

Sleeve 55 is provided with at least one through-opening 59. The through-openings may comprise lengthwise slots as shown in FIG. 1 or circular bores (as discussed in connection with the FIG. 5 embodiment below). At least one of the at least one through opening is long enough that it makes possible an influx to cross bores 60 in hollow piston 54 in all axial positions of hollow piston 54 that can be shifted relative to the axially secured sleeve 55. A band-shaped non-return valve 61, which is applied radially to hollow piston 54 and thus covers cross bores 60, is provided radially outside these cross bores 60. This non-return valve 61 that is applied radially outside thus has the function of a pump non-return valve. Because of this, a hydraulic pressure from the axial supply port P can pass through the at least one through-opening 59 and non-return valve 61 to reach into an annular space 62 radially outside non-return valve 61. In contrast, a backflow from this annular space 62 to supply port P is prevented by blocking an inner pressure, which lies above the pressure at supply port P, from non-return valve 61.

In the first valve position of hollow piston 54 relative to bush 52, which is shown in FIG. 2, hydraulic fluid from the oil pump is thus transported via supply port P and non-return valve 61 to the second working port B. In this way, pressure chambers 9 are impressed via hub bores 13, so that rotor 8 pivots relative to stator 1 in one direction of rotation. Pressure chambers 10, which are unavoidably made smaller in this way, press the hydraulic fluid to the first working port A via hub bores 11. From there, the hydraulic fluid reaches tank port T2 via an annular groove 16 on hollow piston 54. The pressure introduced into annular space 62 from the oil pump is locked in by the non-return valve 61 operating as a pump non-return valve and by another non-return valve 33, so that this pressure can only be unloaded into pressure chambers 9 via a gap 38. This pressure in annular space 62, jointly with the other non-return valve 33, prevents the penetration of hydraulic fluid from cross bore 21, which is connected to pressure chambers 10 via port A1. The hydraulic fluid from pressure chambers 10 is consequently guided to the second tank port T2 exclusively via the first working port A, as long as the internal pressure in pressure chambers 10 or cross bore 21 does not increase over the pressure in annular space 62.

As a consequence of its alternating torques, as soon as the camshaft attempts to rotate in the direction to be adjusted, the pressure in pressure chambers 10 and cross bore 21 increases sharply and abruptly. As soon as this pressure is increased far enough above the pressure in annular space 62, the losses at the first working port A and the pre-stressed additional non-return valve 33 are overcome, annular space 62 provides sufficient flow volume to pressure chambers 9 "aspirating" the hydraulic fluid via the second working port B for a rapid adjustment, since sufficient flow volume could not be provided by the oil pump alone. This relationship is also explained in more detail in DE 10 2006 012 775 A1.

Said annular groove 16 on hollow piston 54 is bounded on both sides by a guide web 36 or 30 in each case. Together with another guide web 28, the second guide web 30 forms another annular groove 47, which forms the radial inner boundary of annular space 62. Thus, in the direction pointing from the internal combustion engine to the linear actuator 43, hollow piston 54 has three axially successive guide webs 36, 30, 28, with which hollow piston 54 is guided inside bush 52. The first guide web 36 is thus disposed on the engine side relative to the center or second guide web 30. In contrast, the third guide web 28 is disposed on the actuator side relative to the center or second guide web 30. The cross bore 60 in hollow piston 54 coming from the supply port P is axially disposed between the second guide web 30 and the third guide web 28. The function of the last-named two guide webs 30, 28 is the following:

If the linear actuator 43 is maximally powered up, then hollow piston 54 is shifted against the force of screw-type pressure spring 58 into its end position, which is also the second valve position. In this case, the third guide web 28 closes gap 38 and releases a gap 37 corresponding to FIG. 3 on its side surface 39 facing linear actuator 43. With this gap 37 then opened, access to annular space 62, which was previously closed by a sealing gap 41, is now created. In this case, the supply pressure coming from supply port P can be guided to the first working port A. In this case, rotor 8 pivots in the opposite direction of rotation. The second working port B is relieved of pressure against the third tank port T3 in this way. For this purpose, the third guide web 28 frees up a gap 34 at a cross bore 35 of the second working port B. From there, hydraulic fluid flows outside along hollow piston 54 to the third tank port T3. In this case, hollow piston 54 is provided on this end with a cross bore 46, which has several functions. On the one hand, the volume of hydraulic fluid compressed by sleeve bottom 50 during axial displacement of hollow piston 54 can flow out through cross bore 46 to the third tank port T3. On the other hand, the slight pressure of the hydraulic fluid flowing out from the second working port B to the third tank port T3 acts on both sides of piston bottom 51, so that hollow piston 54 is also pressure-equilibrated in this respect.

A utilization of the camshaft alternating torques is not provided here, in contrast to the valve position according to FIG. 2. Peak pressures as a consequence of camshaft alternating torques are directly conducted from the second working port B to the third tank port T3.

Figure 4:
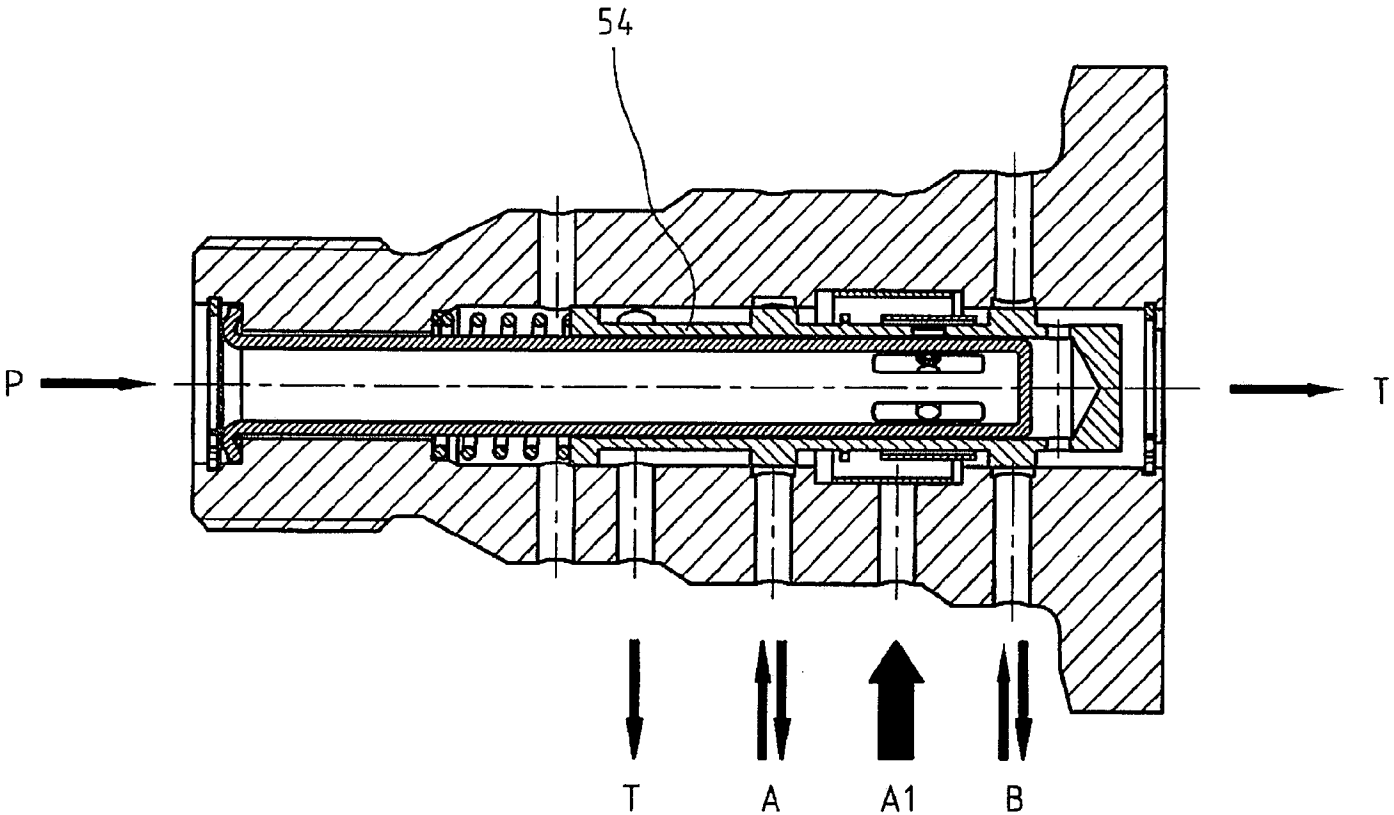
FIG. 4 shows the hydraulic valve from FIG. 2 and FIG. 3 in a blocking center position.

FIG. 4 shows a blocking center position between the two extreme valve positions of hollow piston 54 that are shown. In this blocking center position, the two working ports A, B are closed by the two guide webs 28, 30. In this case, the hydraulic fluid is locked in pressure chambers 9, 10 assigned to the two directions of rotation. If need be, a small flow volume is pressed out from annular space 62 past guide webs 28, 30 to the two working ports A, B and compensates for leakage losses and provides for a damped pivoting of rotor 8 corresponding to DE 198 23 619 A1.

The hydraulic fluid flows from the tank ports T1, T2, T3 into the control drive box. In particular, if this control drive is designed with a chain, the hydraulic fluid equally lubricates the control drive. Wet belt drives are also known.

At the end on the actuator side, bush 52 has an annular groove on the inside, in which an axial locking ring 40 is placed. This axial locking ring 40 serves as the axial stop for the valve position according to FIG. 2 when actuator 43 is not powered up. In an alternative configuration, non-return valve 61 could also extend from the second guide web 30 to the third guide web 28, whereby in this case an additional axial locking element 42 is not provided.

An axial locking element 42, which extends radially toward the outside annularly from hollow piston 54, is provided between the second guide web 30 and the third guide web 28. Here, this axial locking element 42, on the one hand, secures the third guide web 28 and, on the other hand, the non-return valve 61 axially. This prevents the non-return valve 61 from being displaced to such an extent that it no longer sufficiently covers cross bore 60.

Figure 3:
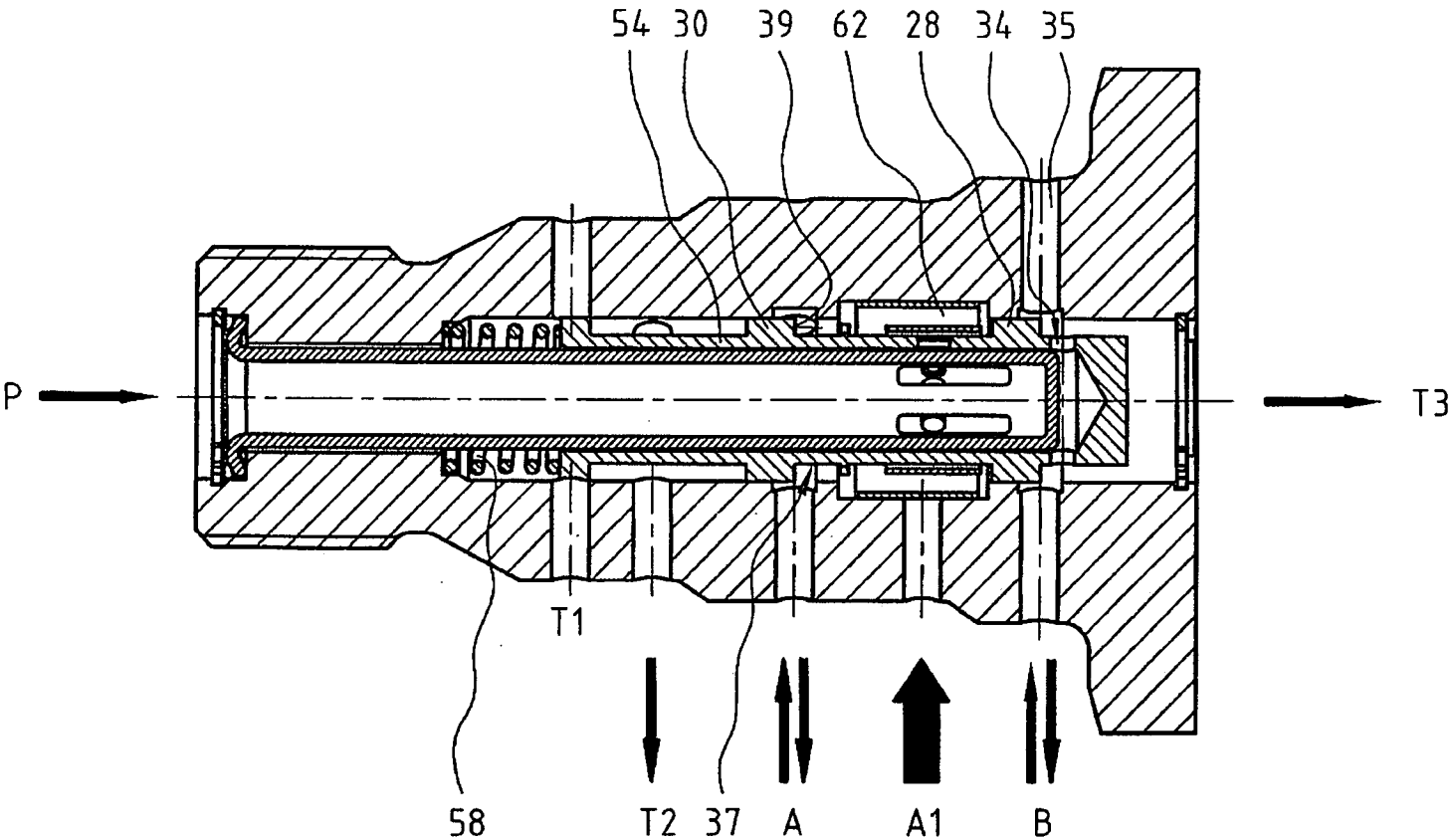
FIG. 3 shows the hydraulic valve of FIG. 2 in a second valve position for adjustment in the other direction of rotation.

Annular groove 16 is sealed via a sealing gap 45 relative to a front side 44 of hollow piston 54 pointing to supply port P. Hydraulic valve 12 would function in fact basically also without the region of hollow piston 54 that, after the center guide web 30, extends up to the first guide web 36. In this case, the screw-type pressure spring 58 would be applied axially at guide web 30. However, the forming of hollow piston 54 with the first guide web 36, which is shown in FIG. 2 to FIG. 4, makes possible a particularly high control performance. Thus, it is particularly obvious in FIG. 2 that the hydraulic flow flowing from the first working port A to the second tank port T2 introduces the same force on the first two guide webs 36, 30 in axially opposite directions. That is, hollow piston 54 is also pressure-equilibrated in this respect. A pressure in annular groove 16 can be built up in this way, since the second tank port T2 forms a throttle site with decreasing flow cross section. If the first guide web 36 were to be omitted, then the hydraulic fluid flowing to the first two tank ports T1, T2 could be applied to the front side of hollow piston 54 and effect a force in the direction pointing to the actuator 43. Screw-type pressure spring 58 is disposed radially outside sleeve 55 in an annular space 64, which leads to a tank port T1 via an opening 63 in bush 52.

Figure 5:
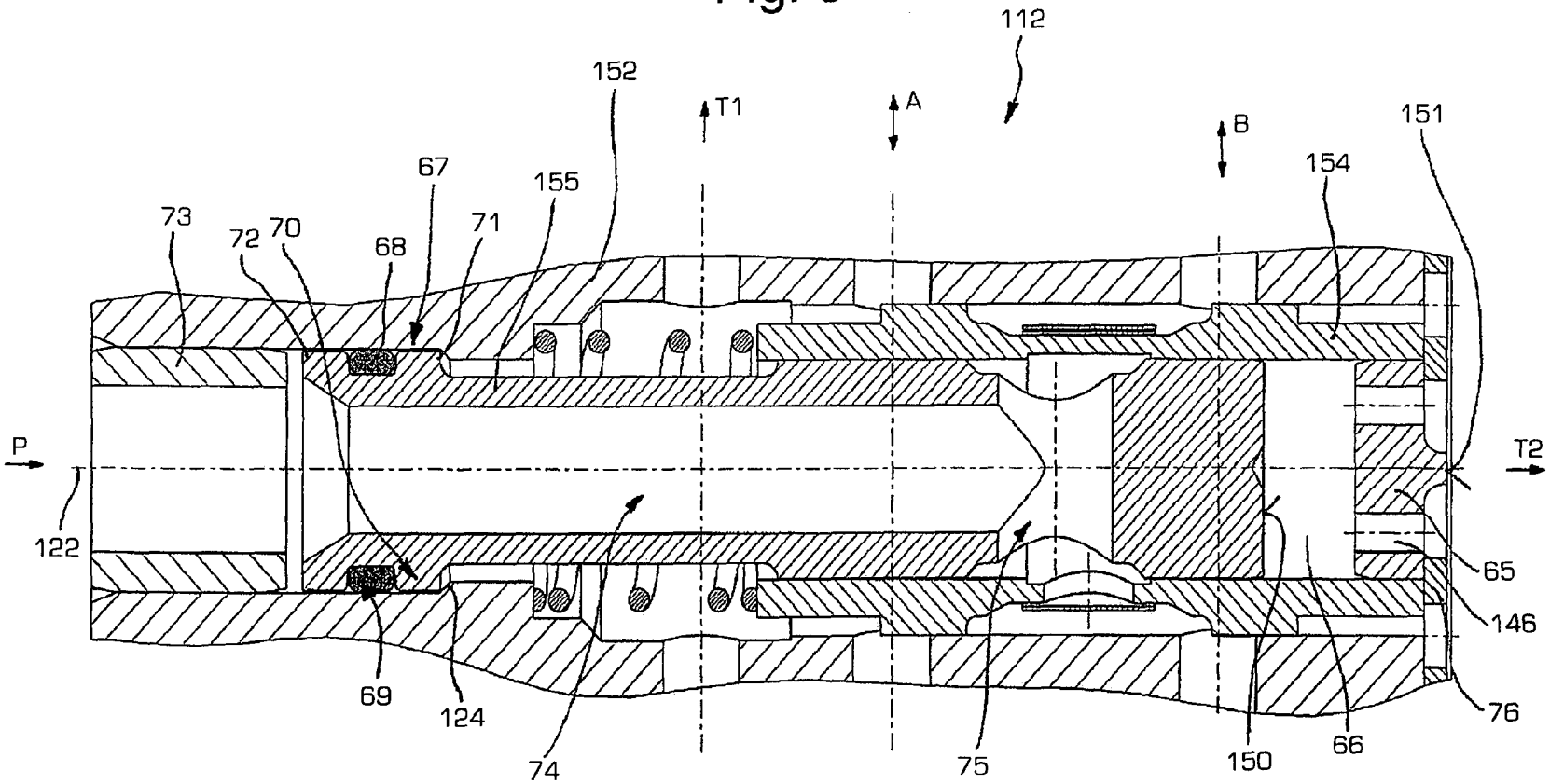
FIG. 5 shows another example embodiment of a hydraulic valve for adjusting an oscillating-motor camshaft adjuster according to FIG. 1.

FIG. 5 shows a hydraulic valve 112 in another embodiment. In this case, an additional port is not provided for the special utilization of camshaft alternating torques. Hollow piston 154 is stopped at a perforated cover 76, which is attached to bush 152, in the direction pointing to the actuator. Instead of sleeve 55 of the previous embodiment, which was deep drawn from sheet metal, sleeve 155 here is designed as a rotating part with a lengthwise bore 74 and a cross bore 75. Hollow piston 154 is not designed in one part with a piston bottom 151, but as an insert 65 pressed in an axially fixed manner into through-drilled hollow piston 154. Outside of central axis 122, this insert 65 is drilled with bores 146, which, analogously to cross bores 46 of the previous embodiment, relieve pressure from a space 66 between piston bottom 151 and sleeve bottom 150 to the second tank outlet T2. This pressure relief is necessary, since it occurs as a consequence of the relative displacement between hollow piston 154 and sleeve 155 relative to the volume change of space 66, which must be equilibrated with oil and/or air through bores 146.

On its end 67 facing away from the actuator, sleeve 155 has an annular groove 69, in which a sealing ring 68 designed as an O-ring is taken up. On this end 67, the outer diameter of sleeve 155 has a large radial play relative to the associated uptake bore 70 of bush 152. This large play is equilibrated by sealing ring 68, so that despite this play, no hydraulic leakage of oil occurs between:

the supply port P, and the first tank outlet T1 or, in fact, the first working port A.

The relatively large radial play in this case, in addition to an axial play, makes it possible for hollow piston 154 to be tilted slightly and offset parallel to central axis 122. In this way, errors of a coaxial type, which are caused by the manufacture or by the tolerances and are found between sleeve 155, hollow piston 154 and bush 152 are equilibrated, so that a jamming of hollow piston 154 cannot occur. In order to make axial play possible, but also to limit it, end 67 of 155 has stops 71, 72 in the two directions pointing away from one another, analogous to collar 25 of the previous embodiment. One stop 71 can come to rest in this case on a shoulder 124 of bush 152. In contrast, the other stop 72 can come to rest at a stop sleeve 73 solidly inserted in bush 152.

In this embodiment, as also in the previous embodiment, a sealing ring 68 can find use for the equilibration of tolerances caused by manufacturing. The annular groove 69 for taking up sealing ring 68 can be provided both in sleeve 55 or 155 as well as in bush 52 or 152.

The non-return valves may be designed with or without overlap. An alternative configuration of a band-shaped non-return valve is known from EP 1 703 184 B1. Instead of the asymmetrical distribution of through-openings to be closed by the non-return valve, which is claimed in this European Patent Specification, it is also possible to dispense with an overlap and to provide an anti-rotating element on the non-return valve.

The described embodiments only involve exemplary configurations. A combination of the described features for the different embodiments is also possible. Additional features for the device parts belonging to the invention, particularly those which have not been described, can be derived from the geometries of the device parts shown in the drawings.

LIST OF REFERENCE CHARACTERS

1 Stator
2 Drive wheel
3 Stator base
4 Webs
5 Intermediate spaces
6 Vane
7 Rotor hub
8 Rotor
9 Pressure chambers
10 Pressure chambers
11 Hub bores
12 Hydraulic valve
13 Hub bore
14 Oscillating-motor camshaft adjuster
15 Annular groove
16 Annular groove
17 Annular groove
18 Annular groove
19 Cross bore
20 Cross bore
21 Cross bore
22 Central axis
23 Wall
24 Shoulder
25 Collar
26 Side
27 Other side
28 Third guide web
29 Axial locking ring
30 Second guide web
31 Annular groove
32 Annular groove
33 Non-return valve
34 Gap
35 Cross bore
36 First guide web
37 Gap
38 Gap
39 Side surface
40 Axial locking ring
41 Sealing gap
42 Axial locking element
43 Actuator
44 Front side
45 Sealing gap
46 Cross bore
47 Annular groove
48 Tappet
49 Screw head
50 Sleeve bottom
51 Piston bottom
52 Bush
53 Outer thread
54 Hollow piston
55 Sleeve
56 Blind hole
57 Blind hole base
58 Screw-type pressure spring
59 Through-opening(s)
60 Cross bore
61 Non-return valve
62 Annular space
63 Opening
64 Space
65 Insert
66 Space
67 End
68 Sealing ring
69 Annular groove
70 Uptake bore
71 Stop
72 Stop
73 Stop sleeve
74 Lengthwise bore
75 Cross bore
76 Cover
112 Hydraulic valve
122 Central axis
124 Shoulder
146 Bores
150 Sleeve bottom
151 Piston bottom
152 Bush
154 Hollow piston
155 Sleeve
T1 Tank outlet
T2 Tank outlet

What is claimed is:

1. A hydraulic valve for an oscillating-motor camshaft adjuster, comprising:

a bush, a hollow piston with a piston bottom on which an actuator is applied, the piston being axially movable within the bush by means of the actuator against a force of a screw-type pressure spring, a sleeve within the hollow piston which is secured in the bush and disposed for movement relative to the piston, and a wall of the sleeve having at least one though-opening, which leads to at least one opening of the hollow piston, the at least one opening of the hollow piston leading a supply pressure applied inside the sleeve alternatively to two sets of pressure chambers of the oscillating-motor camshaft adjuster, wherein:

the sleeve has a sleeve bottom closing an inside space of the hollow piston, the bush has two working ports for adjusting the two sets of pressure chambers, the two working ports are axially distanced relative to one another, and an additional port is provided between the two working ports for utilizing camshaft alternating torques.

2. A hydraulic valve according to claim 1, wherein the at least one through-opening of the sleeve, in a direction of a central axis of the hydraulic valve, is long enough that the at least one opening of the hollow piston opens up into the at least one through-opening in two piston positions in order to load the two sets of pressure chambers.

3. A hydraulic valve according to claim 1, wherein the at least one opening of the hollow piston is covered radially on an outside by a band-shaped non-return valve that encircles the at least one opening.

4. A hydraulic valve according to claim 3, wherein:

the non-return valve is a pump non-return valve, which blocks a return from an annular space into a supply port, if a pressure in the annular space is nearly equal to a pressure of the supply port, and the non-return valve is secured axially by means of webs extending radially from the hollow piston.

5. A hydraulic valve according to claim 1, wherein:

the hollow piston has two guide webs, between which is disposed the at least one opening, hydraulic pressure coming from the at least one opening can be conducted from the two guide webs to one of the two working ports, and the hydraulic pressure coming from the other of the two working ports can be guided from one of the two guide webs to one of two tank ports.

6. A hydraulic valve according to claim 5, wherein the working port arranged closer to the supply port can be guided via an annular groove of the hollow piston to one of the tank ports, which is sealed via a sealing gap opposite a front side of the hollow piston pointing to the supply port.

7. A hydraulic valve according to claim 1, wherein:

the screw-type pressure spring is disposed in an annular space radially outside the sleeve, and the annular space leads to a tank port via an opening in the bush.

8. A hydraulic valve according to claim 1, wherein, on an end facing away from the actuator, the sleeve has a radial play relative to the bush, which is bridged by means of an elastically deformable sealing element, so that a gap is sealed between the sleeve and the bush.

9. A hydraulic valve according to claim 8, wherein the sleeve has a limited axial movability relative to bush.

10. A hydraulic valve according to claim 1, wherein a space, which is relieved of pressure relative to a tank port by means of cross bores, is formed inside the hollow piston between the sleeve bottom and the piston bottom.

11. A hydraulic valve according to claim 1, wherein the hydraulic valve is a central valve.

12. A hydraulic valve according to claim 1, wherein the hydraulic valve is a cartridge valve.

* * * * *